US007625155B1

(12) United States Patent
McKinney et al.

(10) Patent No.: US 7,625,155 B1
(45) Date of Patent: Dec. 1, 2009

(54) MINE ROOF CABLE BOLT ASSEMBLY

(75) Inventors: Janet Faye McKinney, Beckley, WV (US); Larry Brock McKinney, Beckley, WV (US)

(73) Assignee: Safe Overhead Systems, Inc., Beckley, WV (US)

( * ) Notice: Subject to any disclaimer, the term of this patent is extended or adjusted under 35 U.S.C. 154(b) by 0 days.

(21) Appl. No.: 12/434,841

(22) Filed: May 4, 2009

Related U.S. Application Data

(63) Continuation-in-part of application No. 12/410,496, filed on Mar. 25, 2009.

(51) Int. Cl.
*E21D 21/00* (2006.01)

(52) U.S. Cl. ..... 405/302.2; 405/302.1; 405/259.1

(58) Field of Classification Search ..... 405/259.1, 405/302.1, 302.2, 288
See application file for complete search history.

(56) References Cited

U.S. PATENT DOCUMENTS

| | | | | | |
|---|---|---|---|---|---|
| 4,289,426 | A | | 9/1981 | Chaiko | |
| 4,650,373 | A | | 3/1987 | Seegmiller | |
| 4,708,559 | A | * | 11/1987 | Locotos | 405/302.1 |
| 5,147,151 | A | * | 9/1992 | Hipkins, Jr. | 405/259.1 |
| 5,375,946 | A | | 12/1994 | Locotos | |
| 5,525,013 | A | * | 6/1996 | Seegmiller et al. | 405/302.2 |
| 5,531,545 | A | * | 7/1996 | Seegmiller et al. | 405/302.2 |
| 5,556,234 | A | | 9/1996 | Oldsen et al. | |
| 5,570,976 | A | * | 11/1996 | Fuller et al. | 405/302.2 |
| 5,622,454 | A | * | 4/1997 | Ashmore et al. | 405/302.2 |
| 5,769,570 | A | * | 6/1998 | Stankus et al. | 405/302.1 |
| 5,829,922 | A | * | 11/1998 | Calandra et al. | 405/302.2 |
| 5,885,031 | A | | 3/1999 | White | |
| 5,919,006 | A | | 7/1999 | Calandra, Jr. et al. | |
| 5,954,455 | A | | 9/1999 | Eaton et al. | |
| 6,039,509 | A | * | 3/2000 | Locotos | 405/302.2 |
| 6,056,482 | A | * | 5/2000 | Calandra et al. | 405/302.2 |
| 6,270,290 | B1 | | 8/2001 | Stankus et al. | |
| 6,402,433 | B1 | | 6/2002 | Gillespie | |
| 6,428,243 | B1 | * | 8/2002 | Hutchins | 405/259.1 |
| 6,561,721 | B2 | * | 5/2003 | Lausch et al. | 405/302.2 |
| 6,957,931 | B2 | | 10/2005 | Slater | |
| 7,044,688 | B2 | | 5/2006 | Dever et al. | |
| 7,066,688 | B2 | | 6/2006 | Wallstein et al. | |
| 2007/0269274 | A1 | | 11/2007 | Seedsman | |
| 2007/0274788 | A1 | | 11/2007 | Ravat | |

* cited by examiner

*Primary Examiner*—Frederick L Lagman
(74) *Attorney, Agent, or Firm*—Dinsmore & Shohl LLP; Monika J. Hussell

(57) ABSTRACT

Cable bolt assemblies including tension cylinders and tension nuts, alone or in combination with cables and roof bearing plates, for use in underground mines to support mine roofs, are disclosed herein, as well as methods of securing roof cables to and within a mine roof for superior and immediate support. The cables have a first end securable within a borehole in a roof, a second end for exposure from the borehole, and a weight bearing nut secured to the second end. The tension cylinder accommodates, yet is not affixed to, the cable, and includes a threaded exterior surface and an interior cable-accommodating channel. The tension nut has a threaded interior surface complementary to the threaded exterior surface of the tension cylinder, and is rotatable about the tension cylinder. The assembly with the cable and roof bearing plate are positioned within the borehole so that the tension cylinder is within and extends beyond the aperture of the roof bearing plate, and rests against the weight bearing nut of the cable. As the tension nut is rotated about the tension cylinder, and until the nut has compressed the roof bearing plate against the mine roof, the cable does not rotate or twist.

20 Claims, 5 Drawing Sheets

MINE ROOF CABLE BOLT ASSEMBLY

BACKGROUND

This application is a continuation-in-part of application Ser. No. 12/410,496, filed Mar. 25, 2009.

The present invention relates generally to mine roof cable bolt assemblies and components thereof operable to support roofs in underground coal mines and other underground facilities.

Underground coal mines often are hazardous environments, and preventing a roof collapse is a top priority of mining companies. Generally, two products are used to support a roof—roof bolts, and roof cables. Roof bolts are the primary support for the roof; however, over time, mining companies have installed roof cables in boreholes drilled into the roof, with roof bearing plates at an end thereof. These cable systems have been installed to support the roof in the event of a roof bolt failure, and are not designed or installed to provide an immediate supportive, compressive force against the roof (until the roof bolts begin to fail, and the roof begins to drop).

At least one device has attempted to support the roof with a roof cable upon installation and prior to a failure of a roof bolt, as described in U.S. Pat. No. 6,402,433 to Gillespie. This patent discloses a roof cable having a cable with a head end formed of an externally threaded outer sleeve, where the cable bolt shaft has an enlarged section that is slightly larger than the internal diameter of the bolt head outer sleeve so that the cable interferes with the bolt head outer sleeve as the cable is pressed into the outer sleeve to form the cable bolt. Integral to Gillespie is enlarging the cable end and affixing an outer sleeve thereto; thus, the outer sleeve and the enlarged cable end rotate as a single unit.

After a cable is secured within a borehole, rotation of the cable in either direction releases necessary, or stores undesirable, potential energy; thus, an advantage of the present invention removes this storage or release of potential energy by allowing the independent rotation of each of the tension cylinder and the cable, thereby allowing of the full strength of the cable to support the mine roof.

SUMMARY

The present invention provides cable bolt assemblies, or components thereof, to support and retain underground mine roofs. In accordance with an embodiment of the present invention, a cable bolt assembly for supporting mine roofs includes a cable, a tension cylinder, a tension nut, and a roof bearing plate. The cable has a first end intended to be secured within a borehole in a roof, a second end for exposure from the borehole, and a weight bearing nut or other cable termination means secured to the second end of the cable. The tension cylinder comprises a cable-accommodating channel and a threaded exterior surface. The channel extends along a longitudinal axis of the tension cylinder, sized to accommodate but not affix or secure to the cable. Thus, the tension cylinder and the cable rotate independently of one-another. The tension nut has an interior aperture, the surface of the aperture being threaded complementary to the threaded exterior surface of the tension cylinder so that it is rotatable about the tension cylinder. Finally, the roof bearing plate is provided with an aperture therethrough, the aperture being sized to receive and accommodate the tension cylinder.

The assembly may be installed in a mine roof by inserting the cable into the respective apertures of the tension cylinder and the roof bearing plate; securing the first end of the cable into the borehole in a manner so that the second end of the cable, the tension cylinder, the roof bearing plate and the cable termination means are exposed from the borehole; positioning the tension cylinder so that the cylinder rests on the cable termination means, while a portion of the cylinder remains within the aperture of the roof bearing plate; positioning the roof bearing plate near the roof surface; and positioning and rotating the tension nut about the tension cylinder until it compresses the roof bearing plate against the mine roof, thereby causing the bottom surface of the tension cylinder to press against the cable termination means to tense the cable.

In accordance with another embodiment, an assembly for securing cables and roof bearing plates to underground mine roofs is provided, including a tension cylinder and a tension nut. The tension cylinder has an interior channel and a threaded exterior surface, wherein the channel extends along a longitudinal axis of the tension cylinder, and the channel is sized to receive and accommodate a cable without being affixed or secured thereto, thereby allowing the tension cylinder and the cable to rotate independently of one-another when assembled. The tension nut has an aperture with a threaded interior surface complementary to the threaded exterior surface of the tension cylinder, so the tension nut is rotatable about the tension cylinder.

These embodiments may further include a disc or collar, the disc having an interior diameter and at least a partial rim protruding vertically from the disc surface, at the interior diameter of the disc. The disc should be sized to insert the rim thereof into the aperture of a roof bearing plate, with the planar surface of the disc resting against the surface of the roof bearing plate. The rimmed inner circumference of the disc is sized to receive and secure the tension cylinder therein.

A method of securing a cable bolt assembly to a mine roof is also presented, with the method including inserting a cable into interior channels or apertures of a roof bearing plate and a tension cylinder, and securing to the second end of the cable a weight bearing nut. The first end of the cable is secured within a borehole of a mine roof, so that the first end of the cable is near the top of the borehole, and the second end is at least partially exposed from the borehole. The roof bearing plate is positioned near the roof, with the tension cylinder extending through the aperture of the roof bearing plate and resting on the weight bearing nut. A tension nut is provided to compress the roof bearing plate against the roof. Each of the tension cylinder and the tension nut have complimentary threaded surfaces, and are sized and configured so that the tension nut is rotatably and removably secured about the tension cylinder. The channel of the tension cylinder is sufficiently large to accommodate the cable without being affixed or secured thereto, thereby allowing the tension cylinder and the cable to rotate independently of one-another. The assembly is affixed in place to secure the roof by rotating the tension nut about the tension cylinder so that the roof bearing plate is compressed against the mine roof, and the bottom surface of the tension cylinder is forced against the weight bearing nut, thereby tensing the cable.

When provided and supplied, a collar having an interior diameter with at least a partial rim protruding vertically from the disc surface at the interior diameter, is incorporated into the assembly above or preferably below the roof bearing plate, with the rim being inserted into the aperture of the roof bearing plate, and the remainder of the disc resting against the surface of the roof bearing plate. The rimmed inner circumference of the disc forms a channel sized to receive and secure the tension cylinder within the aperture of the roof bearing plate.

A dual-diameter borehole may be drilled in the mine roof prior to inserting the first end of the cable into the borehole, the borehole having a first diameter proximal to an entry of the borehole (or roof surface) and a second diameter distal from the entry of the borehole and smaller than the first diameter.

BRIEF DESCRIPTION OF THE DRAWINGS

The following detailed description of specific embodiments can be best understood when read in conjunction with the following drawings, where like structure is indicated with like reference numerals and in which.

Figure 1:
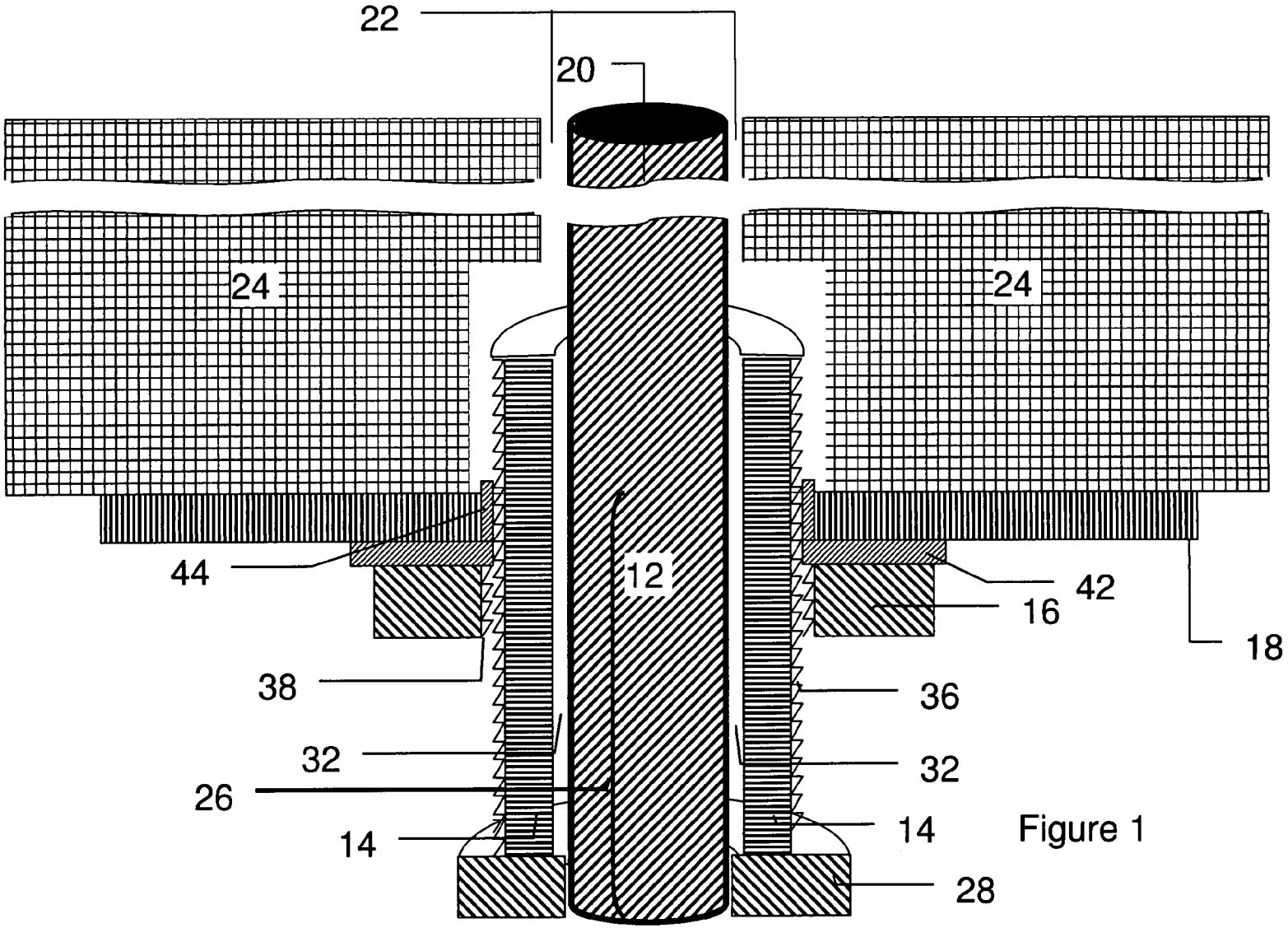
FIG. 1 is an illustration of a cross-sectional view of a cable bolt assembly according to an embodiment of the present invention, installed in a mine roof in accordance with a method of installation as herein described.
Figure 2:
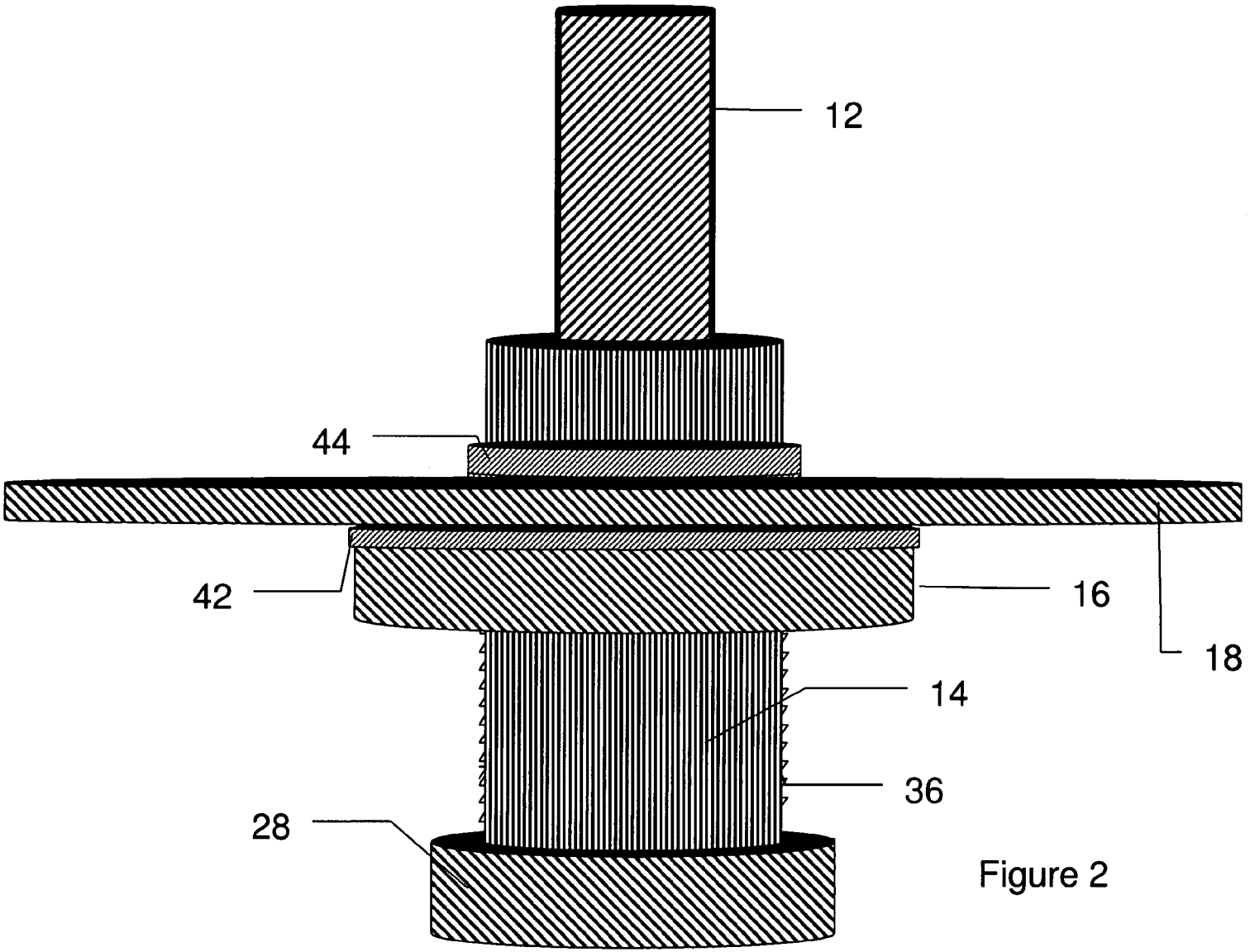
FIG. 2 is an illustration of a cable bolt assembly according to an embodiment of the present invention.

The embodiments set forth in the drawings are illustrative in nature and are not intended to be limiting of the embodiments defined by the claims. Moreover, individual aspects of the drawings and the embodiments shown therein will be more fully apparent and understood in view of the detailed description that follows.

DETAILED DESCRIPTION

Embodiments of the present invention relate generally to cable bolt assemblies for installation in underground mine roofs, and are generally operable to support and retain the roofs.

Referring to the embodiments illustrated in FIGS. 1-4, a cable bolt assembly includes a cable 12, a tension cylinder 14, a tension nut 16, and a roof bearing plate 18. The cable 12 may be configured as one of any variety of multi-strand cables known in the art that are suitable for the purposes described herein. The cable 12 has a first end 20 for insertion into a borehole 22 in a roof 24, a second end 26 for exposure from the borehole, and a weight bearing nut 28 secured to the second end of the cable. The first end of the cable generally is securable within the borehole 22, preferably with a resin adhesive or other materials or structures used to secure cables into boreholes of a mine roof. The weight bearing nut 28 may be a hexagonal nut, a sphere, or other means suitable to secure to the end of the cable and support the tension cylinder as hereinafter described.

The tension cylinder 14 accommodates, yet is not affixed to, the second end 26 of the cable 12. The tension cylinder 14 includes a cable-accommodating channel 32 that extends along a longitudinal axis of the tension cylinder, and a threaded exterior surface 36. The cable bolt assembly generally is arranged such that the second end 26 of the cable 12 is accommodated by the channel 32 of the tension cylinder. As such, while the tension cylinder 14 accommodates the cable 12, it rotates freely from the cable. The channel 32 is smaller than the weight bearing nut 28, so that the tension cylinder may rest on and press against the weight bearing nut, causing the cable to tense when the assembly is installed in a mine roof, as hereinafter described.

The tension nut 16 includes an aperture, having a threaded inner surface 38 complimentary to the threaded exterior surface 36 of the tension cylinder 14. Thus, the tension nut 16 is rotatable about the tension cylinder 14 via the complementary threaded surfaces to compress the roof bearing plate 18 against the roof 24, causing the tension cylinder 14 to push against the weight bearing nut 28 to tense the cable 12. The exterior of the tension nut 16 may be any shape, but is preferably hexagonal or otherwise comprising a plurality of straight edges so that it can be rotated about the tension cylinder 14 and compressed against the roof bearing plate 18 by means of a wrench or other similar device.

The roof bearing plate 18 includes an aperture sized to receive a portion of the tension cylinder 14, so that the cylinder is positioned within said aperture, and extends below and in most instances above the roof bearing plate. The roof bearing plate may be any shape, but is preferably rectangular.

Figure 5D:
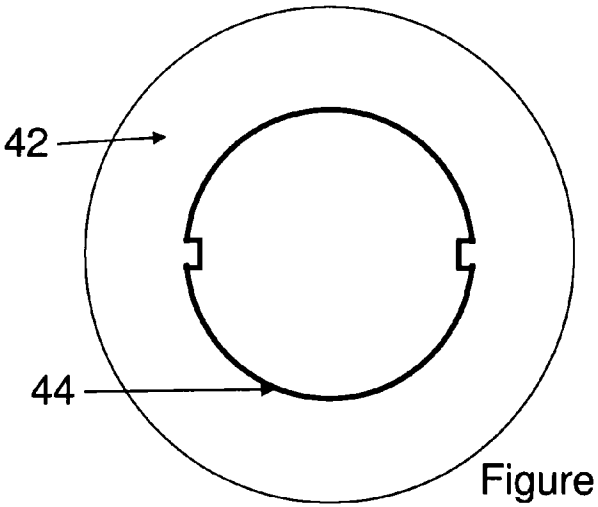
FIG. 5D shows an alternate embodiment for the collar.
Figure 5A:
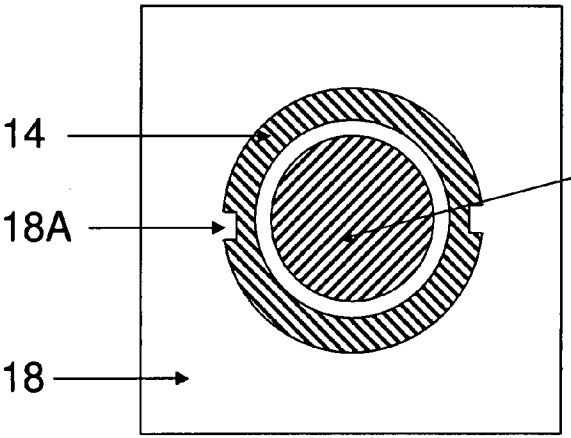
FIG. 5A is an illustration of an embodiment of a tension cylinder and roof bearing plate, viewed from the bottom.
Figure 5C:
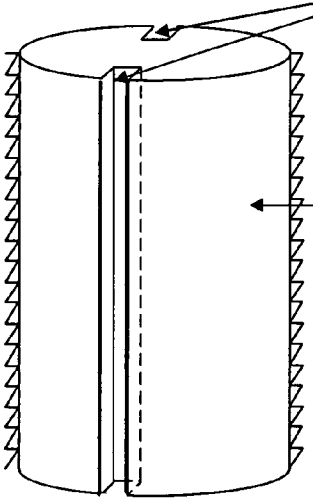
FIG. 5C is an illustration of the tension cylinder in this embodiment.
Figure 5B:
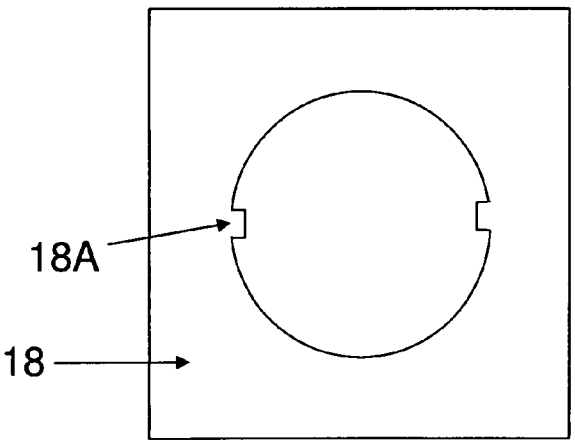
FIG. 5B is an illustration of the roof bearing plate in this embodiment.

In an embodiment, as depicted in FIGS. 5A, 5B and 5C, the roof bearing plate 18 has at least one extending surface 18A at the aperture thereof, extending radially from the plate into the aperture, which extending surface preferably has the same thickness as the thickness of the plate 18. Corresponding indentation(s) 14A are sized and positioned radially inwardly on at least a portion of the exterior surface of the tension cylinder, having a length parallel to the longitudinal axis of the cylinder, so that, as depicted in FIG. 5A, each indentation 14A of the tension cylinder receives a corresponding extending surface 18A of the roof bearing plate, when the cylinder is positioned within the aperture of the roof bearing plate. Preferably, there are at least two extending surfaces at the aperture of the roof bearing plate, at or near 180 degrees from one-another, with corresponding indentations (corresponding in size and location) on the tension cylinder. The shapes of the extending surfaces and indentations are preferably rectangular, with the indention having slightly larger dimensions than the extending surfaces, so that they are appropriately sized to receive the extending surfaces. In order to maintain the integrity of the threaded surface of the tension cylinder, and its engagement with the tension nut, the width of each indentation (the dimension along the circumference of the tension cylinder from which the indentation is depressed) is preferably no larger than one-fourth of the circumference of the tension cylinder, and more preferably no larger than one-eighth of the circumference of the tension cylinder; further, the sum of the widths of the indentations are no greater than one-half of the circumference of the cylinder, and more preferably no greater than one-fourth of the circumference of the cylinder.

When fully assembled the roof bearing plate 18 is positioned near the mine roof 24, with the tension cylinder 14 positioned within the aperture thereof, and the cable 12 (affixed or prepared for affixation within the mine roof) extending through the channel 32 of the tension cylinder. The tension cylinder 14 rests against the weight bearing nut 28 secured to the second end of the cable, and the tension nut 16 is positioned about the tension cylinder 14, prepared for rotation.

Rotation of the tension nut 16 in the compressive direction of rotation advances the tension nut along the tension cylinder 14 and against the roof bearing plate 18, to compress the plate against the roof 24. The tension nut 16 may continue to compress the plate 18 with further rotation until a defined compression of the plate against the roof 24 is achieved (any degree of compression sufficient for the plate 18 to provide support to the roof 24 and to retain the roof if weakened and subject to collapse) and the tension cylinder 14 is forced against the weight bearing nut 28 sufficiently to tense the cable (a degree of cable tension necessary to provide immediate support to the roof 24 and to retain the roof if weakened and subject to collapse). Because final advancement of the tension nut to compress the plate increases the length of the tension cylinder exposed below the plate (while the length and position of the cable relative to the assembly remains unchanged), once the plate is compressed to the roof, the tension cylinder is similarly tensed against the weight bearing nut 28. Thus, the cable 12, secured at the second end 26 to the weight bearing nut 28 and at the first end 20 within the borehole 22, tenses with the compression of the plate against the roof. In some embodiments, the tension cylinder 14 and/or the weight bearing nut 28 may have a layer of polyurethane or similar anti-friction plastic or other material at the interface of said cylinder and nut, or a disc comprised of the anti-friction material may be integrated into the device of the present invention at such interface.

Figure 3:
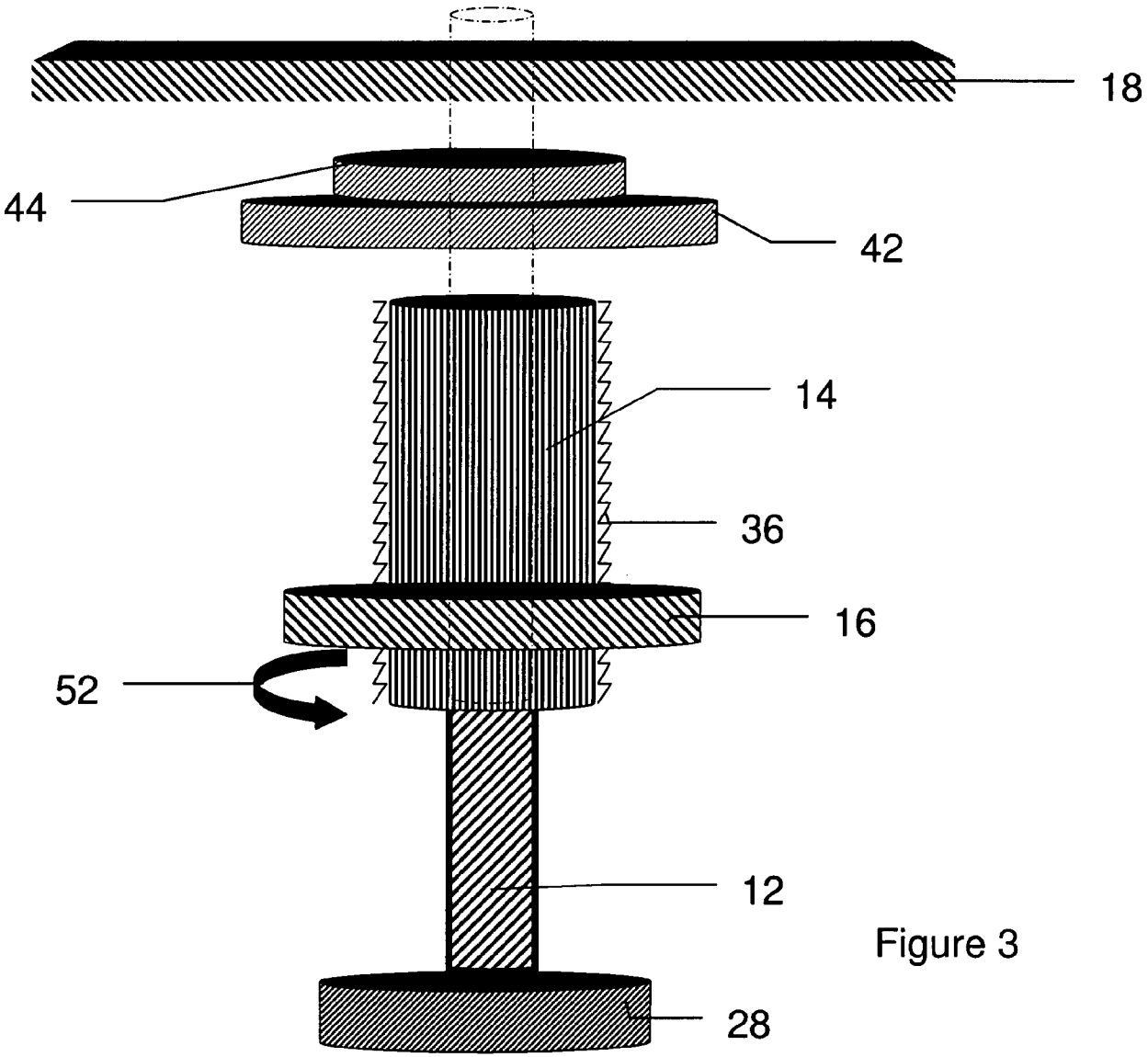
FIG. 3 is an illustration of the components of an embodiment of the present invention.
Figure 4B:
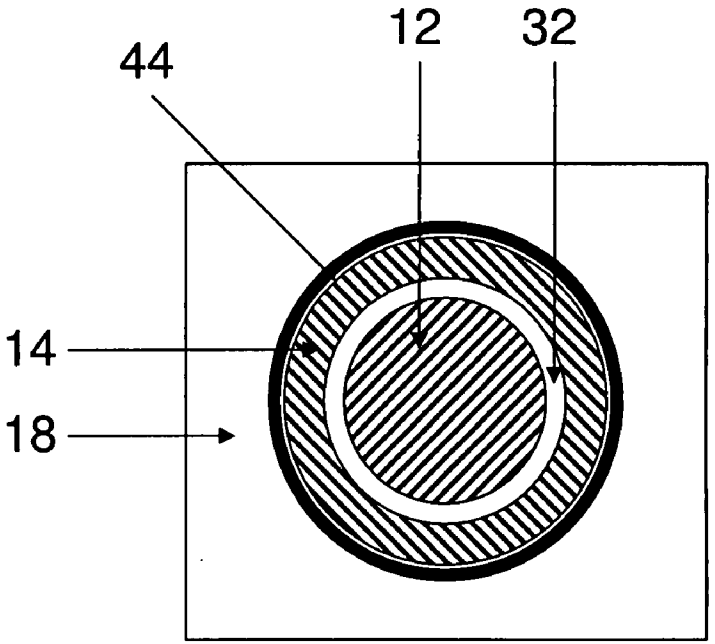
FIGS. 4A and 4B are illustrations of a cable bolt assembly according to an embodiment of the present invention, with FIG. 4A being a view from the bottom, and FIG. 4B being a view from the top.
Figure 4A:
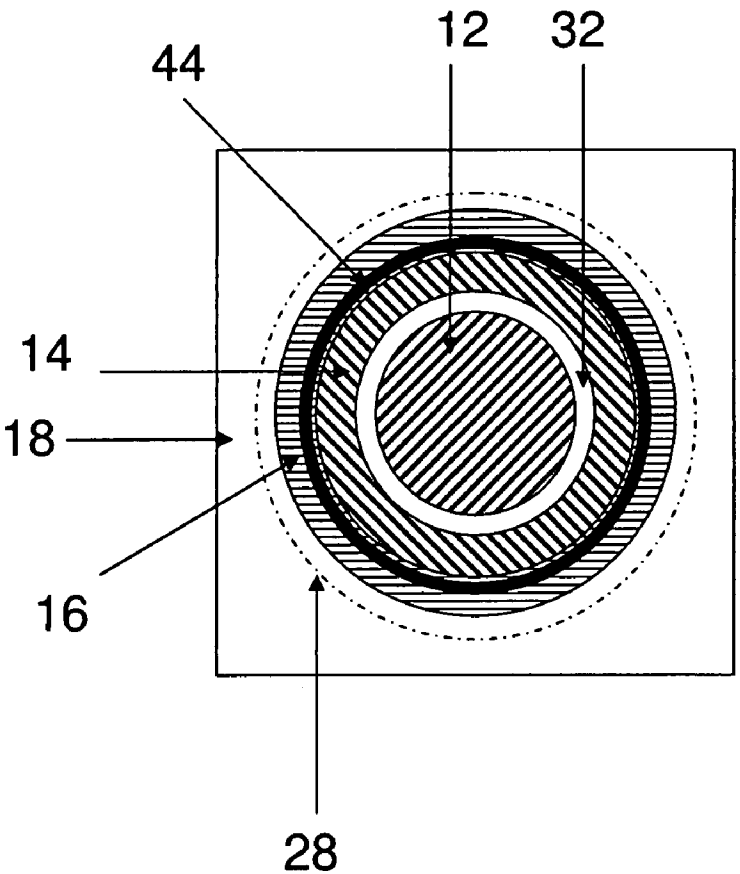

It should be noted that the compressive direction of rotation 52 shown in FIG. 3, where the compressive direction is to the right, are for exemplary purposes only. It is contemplated that such directions may be switched where the compressive direction is to the left and the decompressive direction is to the right.

As shown in FIGS. 1-4, a cable bolt assembly may further comprise a disc or collar 42. The collar 42 generally is positioned between the roof bearing plate 18 and the tension nut 16 to reduce friction there-between with rotation of the tension nut in the compressive direction of rotation. The collar 42 also may comprise an extension or rim 44 sized to position between the wall of the aperture of the roof bearing plate 18 and the threaded exterior surface 36 of the tension cylinder 14, to cause a tight fit there-between when within the aperture of the plate 18. The rim preferably extends from the surface of the roof bearing plate, through and in some embodiments (as shown in the Figures) beyond the depth of the aperture of the roof bearing plate. In some embodiments, the shape of the disc or collar corresponds with the shape of the top surface of the tension nut; preferably, the shape of the disc is larger than the shape of the tension nut to provide full support between the tension nut and the roof bearing plate upon compression. In some embodiments, the extension 44 may be closely sized to the outer circumference of the tension cylinder, causing the threads of the tension cylinder to compress or deform against the exterior wall of the cylinder, further tightening the fit between the cylinder and the plate.

In some embodiments (as shown in FIG. 5D), the rim 44 of the collar 42 may have extending surfaces similar to those described earlier for the roof bearing plate, corresponding to indentations in a tension cylinder 14. These extending surfaces are sized and positioned along the length of the rim (parallel to the rim's longitudinal axis) so that at least some of the indentations 14A of the tension cylinder receive a corresponding extending surface of the rim 44. The extending surfaces of the rim 44 may be hollow (comprising walls, to leave a recess), so that corresponding extending surfaces 18A of the roof bearing plate 18 may be received by the recess formed in this configuration. Preferably, there are at least two extending surfaces on the rim 44, traversing the length thereof, at or near 180 degrees from one-another, with corresponding indentations (corresponding in size and location) on the tension cylinder and, in some embodiments, corresponding extending surfaces on the roof bearing plate. The shapes of the extending surfaces are preferably rectangular, having slightly smaller dimensions than the corresponding indentations 14A (and, when present, the recesses of the extending surfaces of the rim being slightly larger in dimensions than the corresponding extending surfaces 18A of the roof bearing plate 18), so that the indentations of the tension cylinder are sized to receive the extending surfaces of the rim (and, if present, the hollow recesses of the rim extending surfaces are sized to receive the extending surfaces of the roof bearing plate).

Another embodiment of the present invention relates to a method of installing a cable roof support to a mine roof. The method comprises securing a first end of a cable within a borehole in a mine roof such that a second end of the cable, a roof plate, a tension cylinder, a tension nut and a weight bearing nut secured thereto as hereinbefore described, are exposed from the borehole. Thereafter, the tension nut is rotated about the tension cylinder to compress the roof bearing plate against the mine roof, while the tension cylinder is forced against the weight bearing nut. A collar may be inserted with the roof plate, or separately, immediately above or preferably below the roof plate, so that the rim of the collar is within the aperture of the roof plate.

It is contemplated that the method may further comprise drilling a borehole in the mine roof prior to inserting the first end of the cable into the borehole. As shown in FIG. 1, the drilled borehole may be a dual-diameter borehole with a first diameter 48 proximal to the entry of the borehole and a second diameter 46 distal from the entry of the borehole and smaller than the first diameter. It is contemplated that the first, and larger, diameter 48 may facilitate an insertion of the tension cylinder 14 into the borehole, while the second, and smaller, diameter 46 more closely encloses the first end 20 of the cable 12 inserted therein. It is also contemplated, however, that the borehole may have a single, uniform diameter throughout, rather than have a dual-diameter.

In the embodiments described herein, the tension cylinder 14 is preferably longer than the length of the second end 26 of the cable (the length from the roof surface to the top of the weight bearing nut 28), so as to permit full tension of the cable 12 when the roof bearing plate 18 is compressed against the roof 24 by means of the tension nut 16.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A bolt assembly for use with cables to support mine roofs, comprising:

a tension cylinder, the tension cylinder comprising an interior channel and a threaded exterior surface, wherein the exterior surface has one or more indentations extending radially inwardly, wherein the channel and the indentations extend along a longitudinal axis of the tension cylinder, and wherein the channel is sized to receive and accommodate a cable without being affixed or secured thereto, thereby allowing the tension cylinder and the cable to rotate independently of one-another;

a tension nut comprising a threaded interior surface complementary to the threaded exterior surface of the tension cylinder, wherein the tension nut is rotatable about the tension cylinder; and a roof bearing plate comprising an aperture therethrough, said aperture sized to receive and accommodate the tension cylinder, wherein said plate has one or more extending surfaces at and extending radially into the aperture thereof, sized and positioned to fit within the indentations of the tension cylinder.

2. The bolt assembly of claim 1, wherein the roof bearing plate has a defined thickness, and the extending surfaces of the plate have the same thickness as the thickness of the plate.

3. The bolt assembly of claim 1, wherein the tension cylinder comprises two indentations, and the roof bearing plate comprises two extending surfaces.

4. The bolt assembly of claim 3, wherein the indentations are about 180 degrees from one-another, about the longitudinal axis of the tension cylinder.

5. The bolt assembly of claim 1, wherein the indentations and the extending surfaces are rectangular.

6. The bolt assembly of claim 1, wherein the tension cylinder is defined by a circumference, and each indentation has a width of no more than one-fourth of the circumference of the tension cylinder.

7. The bolt assembly of claim 6, wherein each indentation has a width of no more than one-eighth of the circumference of the tension cylinder.

8. The bolt assembly of claim 1, wherein the tension cylinder is defined by a circumference, and the sum of the widths of the indentations is no greater than one-fourth of the circumference of the tension cylinder.

9. A bolt assembly for use with cables to support mine roofs, comprising:

a tension cylinder, the tension cylinder comprising an interior channel and a threaded exterior surface, wherein the exterior surface has one or more indentations extending radially inwardly, and wherein the channel and the indentations extend along a longitudinal axis of the tension cylinder, and wherein the channel is sized to receive and accommodate a cable without being affixed or secured thereto, thereby allowing the tension cylinder and the cable to rotate independently of one-another;

a tension nut comprising a threaded interior surface complementary to the threaded exterior surface of the tension cylinder, wherein the tension nut is rotatable about the tension cylinder;

a roof bearing plate comprising an aperture therethrough, said aperture sized to receive and accommodate the tension cylinder; and a disc having an interior circumference, with at least a partially protruding rim at the interior circumference of said disc, said disc being sized to insert the rim thereof into the aperture of the roof bearing plate, and to receive and accommodate the tension cylinder within the rimmed interior circumference of the disc, wherein said rim has one or more extending surfaces, said extending surfaces being sized and positioned to fit within the indentations of the tension cylinder.

10. The bolt assembly of claim 9, wherein the rim of the disc has a defined length, and the extending surfaces of the disc have the same length as the length of the rim.

11. The bolt assembly of claim 9, wherein the tension cylinder comprises two indentations, and the disc rim comprises two extending surfaces.

12. The bolt assembly of claim 11, wherein the indentations are about 180 degrees from one-another, about the longitudinal axis of the tension cylinder.

13. The bolt assembly of claim 9, wherein the indentations and the extending surfaces are rectangular.

14. The bolt assembly of claim 9, wherein the tension cylinder is defined by a circumference, and each indentation has a width of no more than one-fourth of the circumference of the tension cylinder.

15. The bolt assembly of claim 14, wherein each indentation has a width of no more than one-eighth of the circumference of the tension cylinder.

16. The bolt assembly of claim 9, wherein the tension cylinder is defined by a circumference, and the sum of the widths of the indentations is no greater than one-fourth of the circumference of the tension cylinder.

17. The assembly of claim 9, wherein each of said extending surfaces of said rim comprise a plurality of walls, forming a recess, and wherein said roof bearing plate has one or more extending surfaces at the aperture thereof, extending radially into the aperture, and sized and positioned to fit within a corresponding recess of the rim.

18. A method of securing a cable bolt assembly to a mine roof, the method comprising:

providing (a) a cable having a first end and a second end, and cable termination means secured to the second end of the cable, and (b) a roof bearing plate comprising an aperture therethrough, said aperture being sized to receive and accommodate the tension cylinder, wherein said plate has one or more extending surfaces at and extending radially into the aperture thereof;

further providing (c) a tension cylinder having a bottom surface, the tension cylinder comprising an interior channel and a threaded exterior surface, wherein the exterior surface has one or more indentations extending radially inwardly, wherein the channel and the indentations extend along a longitudinal axis of the tension cylinder, wherein the indentations are sized and positioned to receive the extending surfaces of the roof bearing plate, and wherein the channel receives and accommodates the cable without being affixed or secured thereto, thereby allowing the tension cylinder and the cable to rotate independently of one-another, while inhibiting rotation of the tension cylinder within the roof bearing plate, and (d) a tension nut, the tension nut comprising a threaded interior surface complementary to the threaded exterior surface of the tension cylinder, wherein the tension nut is rotatably and removably secured to the tension cylinder;

securing the first end of the cable within a borehole in a roof in a manner so that when so secured, the second end and the tension cylinder are partially exposed from the borehole, and the weight bearing nut is fully exposed from the borehole;

positioning the tension cylinder so that the bottom surface thereof rests against the weight bearing nut, and the extending surfaces of the roof bearing plate are positioned within the indentations of the tension cylinder; and rotating the tension nut about the tension cylinder until the roof bearing plate is compressed against the mine roof, thereby tensing the cable with the bottom surface of the tension cylinder in contact with the weight bearing nut.

19. The method of claim 18, wherein the method further comprises drilling a dual-diameter borehole in the mine roof prior to the inserting of the first end of the cable into the borehole, with a first diameter proximal to an entry of the borehole and a second diameter distal from the entry of the borehole and smaller than the first diameter.

20. The method of claim 18 further comprising:

providing (e) a disc having an interior circular circumference, with at least a partially protruding rim at the interior circumference of said disc and extending surfaces positioned and projecting radially from the interior of said rim, wherein each of said extending surfaces of said rim are comprised of a plurality of walls, forming a recess, and wherein the extending surfaces of the roof bearing plate are sized and positioned to fit within a corresponding recess of the rim, and positioning said disc below the plate so that the rim thereof extends beyond the opposing surface of the plate, and so that the extending surfaces of the rim are received by the indentations of the tension cylinder, and the hollow recesses of the rim extending surfaces receive the extending surfaces of the roof bearing plate.

* * * * *